US006109541A

United States Patent [19]

Beatty et al.

[11] Patent Number: 6,109,541

[45] Date of Patent: Aug. 29, 2000

[54] APPARATUS FOR REDUCING THE BOUNCE OF A POPPET VALVE

[75] Inventors: David J. Beatty, Bloomington; Steven J. Bockelman, Lacon; Jon E. Kasen, East Peoria, all of Ill.

[73] Assignee: Caterpillar Inc., Peoria, Ill.

[21] Appl. No.: 09/121,437

[22] Filed: Jul. 23, 1998

[51] Int. Cl.[7] ..... F02M 51/00

[52] U.S. Cl. ..... 239/88; 239/585.1; 251/129.16

[58] Field of Search ..... 239/88, 89, 90, 239/585.1; 251/129.16; 335/257, 271, 277

[56] References Cited

U.S. PATENT DOCUMENTS

| | | | |
|---|---|---|---|
| 4,417,693 | 11/1983 | Fussner et al. | 239/453 |
| 4,766,405 | 8/1988 | Daly et al. | 335/257 |
| 4,878,650 | 11/1989 | Daly et al. | 251/129.15 |
| 5,033,176 | 7/1991 | Schiel | 29/116.2 |
| 5,127,585 | 7/1992 | Mesenich | 239/585.5 |
| 5,139,224 | 8/1992 | Bright | 251/50 |
| 5,203,538 | 4/1993 | Matsunaga et al. | 251/129.19 |
| 5,299,776 | 4/1994 | Brinn, Jr. et al. | 251/77 |
| 5,365,804 | 11/1994 | Brunel | 239/88 |
| 5,370,355 | 12/1994 | Rembold et al. | 251/64 |

FOREIGN PATENT DOCUMENTS

| | | |
|---|---|---|
| 999533 | 8/1961 | United Kingdom . |
| 1114370 | 11/1966 | United Kingdom . |

*Primary Examiner*—Lesley D. Morris
*Attorney, Agent, or Firm*—Larry G. Cain

[57] ABSTRACT

Existing poppet valves have a tendency to rebound or bounce during operation. This rebound or bounce adversely affects engine governability, high pressure injector fuel flow, noise and idle stability. The present invention reduces or nearly eliminates poppet valve (52) rebound or bounce. The apparatus (161) for compensating for the rebound of bounce overcomes the problem of variable injection. For example, as the poppet valve (52) rebounds the weight (174) strikes the bottom or contacting surface (168) preventing the poppet valve (52) from moving toward the first position (156). Thus, the variation in the injection of fuel is prevented or eliminated. Additionally, with the variation in the injection of fuel eliminated, the adverse affects of the bounce or rebound enables better engine governability, high pressure injector fuel flow and idle stability with reduced noise.

16 Claims, 4 Drawing Sheets

APPARATUS FOR REDUCING THE BOUNCE OF A POPPET VALVE

TECHNICAL FIELD

This invention relates generally to fuel injectors for an engine and more particularly to an apparatus for reducing the bounce of a poppet valve.

BACKGROUND ART

The use of fossil fuel as the combustible fuel in engines results in the use of a fuel injector for injecting fuel into a combustion chamber. In the combustion chamber, combustion products of carbon monoxide, carbon dioxide, water vapor, smoke and particulate, unburned hydrocarbons, nitrogen oxides and sulfur oxides are formed. Of these above products carbon dioxide and water vapor are considered normal and unobjectionable. Furthermore, noise of combustion is considered an emission. In most applications, governmental imposed regulations are restricting the amount of pollutants being emitted in the exhaust gases and noise by the engine.

The design of many fuel injectors uses either a spring or a high pressure fluid to exert a force which acts on a poppet valve. The force moves the poppet valve into a first position. For example, as the force of the fluid is removed from the poppet valve or a force is exerted on the poppet valve, such as by a magnet, the poppet valve moves into the first position against a stop. Normally, the momentum of the poppet valve impacts the poppet valve against the stop and the poppet valve has a tendency to bounce or rebound from the stop causing the poppet valve to move toward a second position. The poppet valve may rebound and partially move the poppet valve into the second position causing a variation in the injection of fuel. This variation in the injection of fuel is undesirable. Investigation has shown that bounce or rebound adversely affects engine governability, high pressure injector fuel flow, noise and idle stability.

The present invention is directed to overcoming one or more of the problems as set forth above.

DISCLOSURE OF THE INVENTION

In one aspect of the invention, a fuel injector has a poppet valve positioned therein. The poppet valve is operatively movable between a first position and a second position. The fuel injector is comprised of a cavity being formed in the poppet valve and defining a contacting surface. A weight is movably positioned within the cavity. The weight defines an end being positioned in spaced relationship to the contacting surface with the poppet valve in the first position.

In another aspect of the invention, a method of reducing the bounce or rebound of a poppet valve is defined. In operation, the poppet valve has a first position and a second position being spaced one from the other. The poppet valve is movable from the first position to the second position in a first direction. The poppet valves defines a second direction when moving from said second position to the first position. A cavity is formed in the poppet valve and defines a bore having a contacting surface therein. A weight defines an end and is movably positioned within the cavity. The steps of reducing the bounce or rebound of the poppet valve are comprised of the following: positioning the weight within the cavity with the end being adjacent the contacting surface; retaining the weight slidably within the cavity; moving the poppet valve and the weight from the first position to the second position in the first direction; rebounding the poppet valve from the second position toward the first position in the second direction; moving the weight in the first direction as the poppet valve is moving in the second direction; contacting the end of the weight with the contacting surface of the poppet valve; and stopping the second direction of the poppet valve with the weight.

In another aspect of the invention, a poppet valve has a first end portion, an intermediate portion and a second end portion, an upper seat is positioned on the intermediate portion and a lower seat is positioned on the second end portion. The poppet valve is comprised of a cavity being positioned in the second end portion. The cavity defines a bore having a side wall and a bottom. A groove is formed in the side wall and a retainer is positioned in the groove. A weight is movably positioned in the cavity.

BEST MODE FOR CARRYING OUT THE INVENTION

Figure 1:
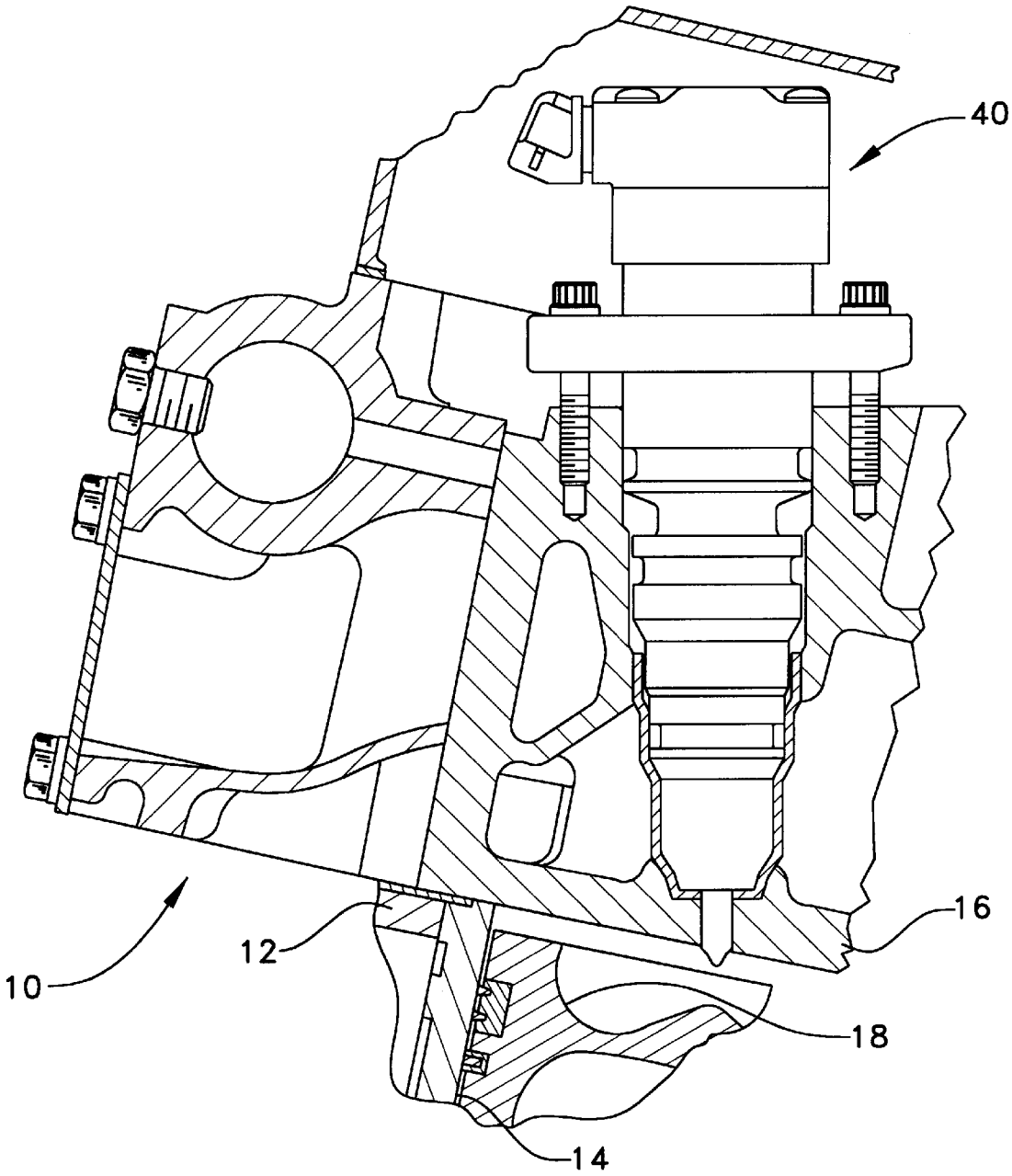
FIG. 1 is a partially sectional view of an engine embodying the apparatus for reducing the bounce of a poppet valve.

Referring to FIG. 1, an engine 10 includes a block 12 having a plurality of cylinders 14 therein, of which only one cylinder 14 is shown. A head 16 is attached to the block 12. Each of the plurality of cylinders 14 has a piston 18 movably positioned therein between a top dead position and a bottom dead position, not shown. The pistons 18 are of conventional construction and are movable in a conventional manner, such as by a crankshaft, not shown.

In this application, the engine 10 is of a conventional four cycle configuration. A unit injector 40 is positioned in the head 16 and corresponds in number to the plurality of cylinders 14.

Figure 2:
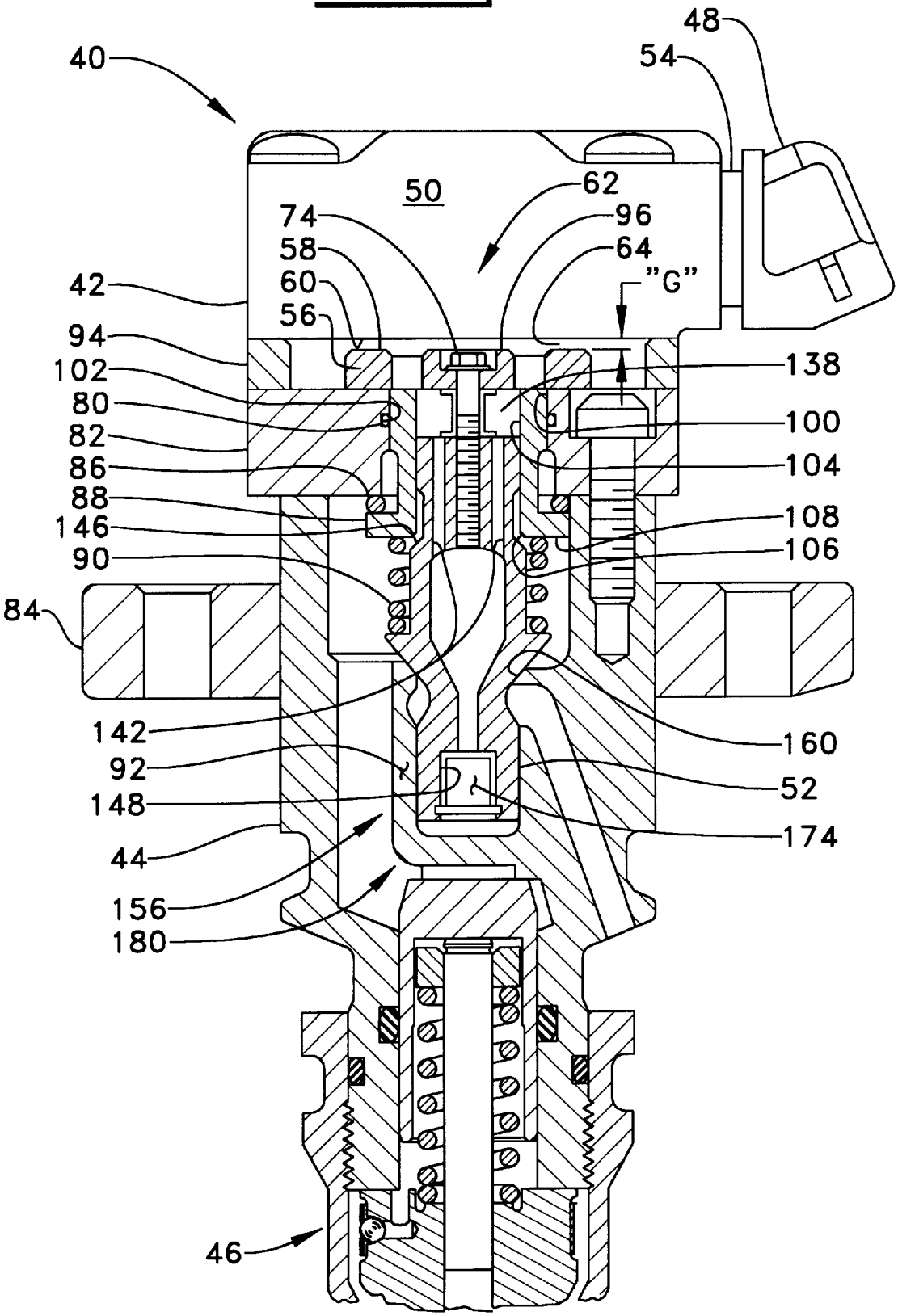
FIG. 2 is an enlarged cross-sectional view of a portion of a fuel injector embodying the apparatus for reducing the bounce of a poppet valve.
Figure 3:
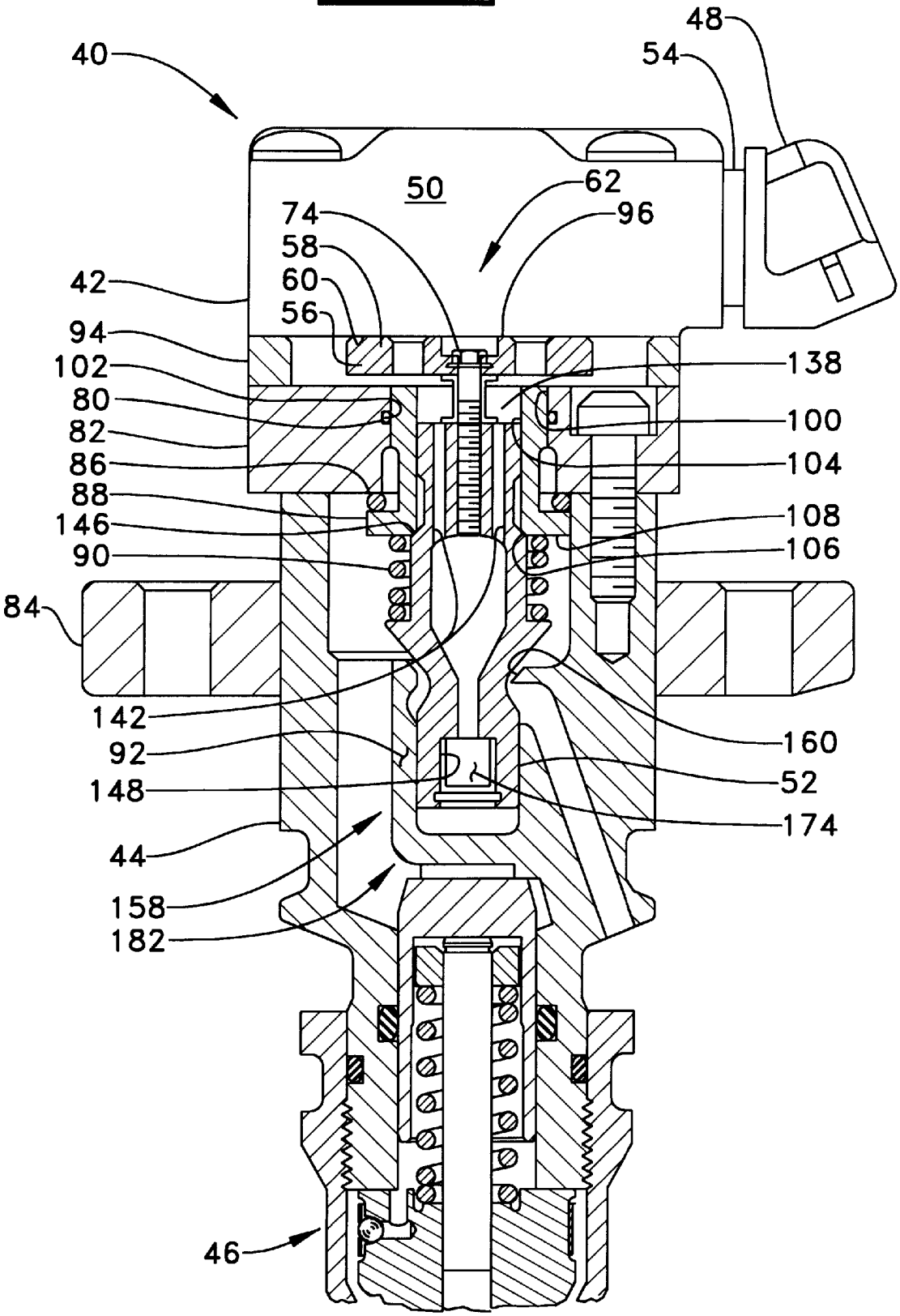
FIG. 3 is an enlarged cross-sectional view of a portion of a fuel injector embodying the apparatus for reducing the bounce of a poppet valve.

A portion of the unit injector 40 is shown in FIGS. 2 and 3. In this application, the unit injector 40 includes an electrical actuator and valve assembly 42. The fuel injector 40 further includes a housing portion 44 and a nozzle portion 46, of which only a portion is shown. The electrical actuator and valve assembly 42 includes an actuator 48, which in this application is a solenoid assembly, and an actuator 50, which in this application is in the form of a poppet valve 52. The solenoid assembly 48 includes a fixed stator assembly 54 and a movable armature 56. The armature 56 has a pair of oppositely-facing planar first and second surfaces 58,60. A means or device 62 for communicating, collecting and raining damping fluid with respect to expandable and contractible cavities of the solenoid assembly 48 is included. The first surface 58 of the armature 56 is spaced from the stator assembly 54 so that the armature 56 and the stator assembly 54 collectively define a cavity 64.

The housing portion 44 includes a fastener 74 threadably connecting the armature 56 to the poppet valve 52 so that the armature 56 and the poppet valve 52 are displaced together as a unit. An adapter o-ring 80, a poppet adapter 82, an annular unit injector clamp 84, a poppet shim 86, a poppet sleeve or member 88, a poppet spring 90 and a piston and valve body 92 are included in the housing portion 44 and are of conventional construction.

An armature spacer 94 has a thickness, measured along the longitudinal axis which is greater than the thickness of the armature 56 by a preestablished amount forming a gap "G", as shown in FIG. 2. For example, the cavity 64 includes the closely-controlled axial clearance or gap "G". In this application, the axial distance of the gap is about 0.377 millimeters or 0.0148 inches when the solenoid assembly is in the deenergized position. The gap "G" helps to determine the amount of damping imparted to the movable armature 56 by the damping fluid which is periodically displaced from the gap "G". The gap "G" also helps to determine the amount of magnetic force imparted by the rotor assembly 54 to the armature when the solenoid assembly is in the electrically energized position, as best shown in FIG. 3.

As further shown in FIGS. 2 and 3, the poppet sleeve 88 is slidably positioned in a main bore 100 of the poppet adapter 82 by a relative loose fit. The adapter o-ring 80 is positioned in the annular clearance between the poppet sleeve 88 and the poppet adapter 82 and is seated in an annular peripheral groove 102 formed in the main bore 100 of the poppet adapter 82. The poppet sleeve 88 is provided with a centrally disposed main bore 104. The poppet sleeve 88 has one end portion which defines an annular (preferably frusto-conical) seat 106 around an entrance to the main bore 104 and an annular shoulder 108.

As shown in FIG. 3, one end of the poppet spring 90 contacts the annular shoulder 108 of the poppet sleeve 88 and the other end of the poppet spring 90 contacts the poppet valve 52. The poppet spring 90 is preferably a helical compression spring and is provided as a means or device for biasing the poppet valve 52 and armature 56 axially away from the stator assembly 54. The poppet spring 90 also biases the poppet sleeve 88 and poppet shim 86 against the fixed poppet adapter 82 such that the poppet valve 52 is normally unseated from the annular seat 106 defined on the poppet sleeve 88.

Figure 4:
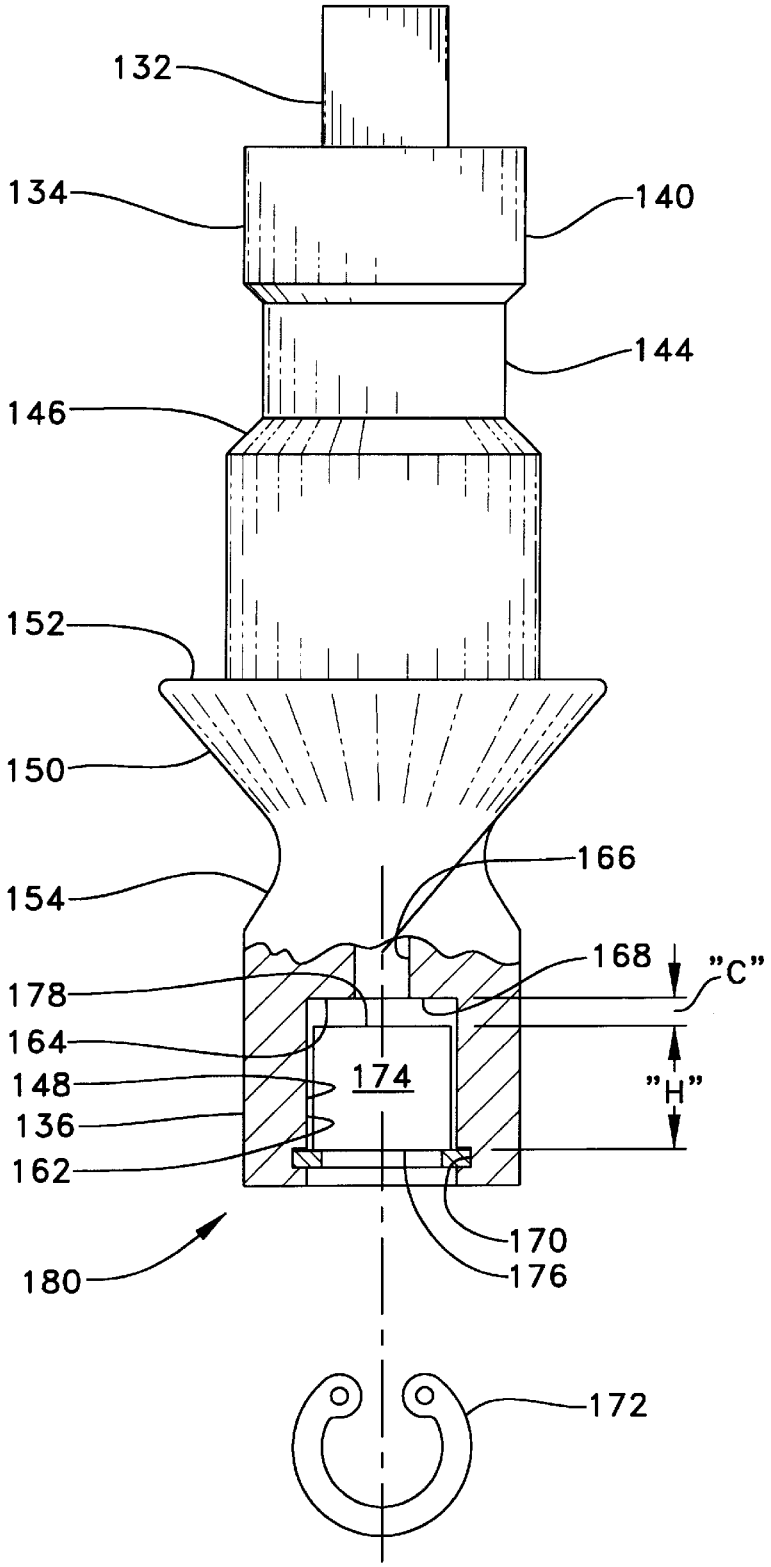
FIG. 4 is an enlarged partially section view of a poppet valve embodying the apparatus for reducing the bounce of a poppet valve.

As shown in FIG. 4, the poppet valve 52 has a first end portion 132, an intermediate portion 134 and a second end portion 136. The first end portion 132 contacts the second surface 60 of the armature 56. The first end portion 132 preferably has a reduced diameter, relative to the intermediate portion 134, and cooperates with the poppet sleeve 88 to define an upper poppet valve cavity 138.

The intermediate portion 134 of the poppet valve 52 has an annular peripheral surface 140 and a pair of passages 142. The annular peripheral surface 140 of the poppet valve 52 is positioned within the main bore 104 of the poppet sleeve 88 according to a selected annular clearance. This annular clearance preferably provides a slip fit between the poppet valve 52 and the poppet sleeve 88. The outer peripheral surface of the poppet sleeve 88 is positioned in the main bore 100 of the poppet adapter 82 according to a selected diametrical clearance. An upper annular peripheral groove 144 and an annular first or upper seat 146 are defined on the annular peripheral surface 140 of the poppet valve 52. The shape of the upper seat 146 of the poppet valve 52 is preferably semi-spherical but, alternatively, may be frusto-conical. The poppet valve upper seat 146 is adapted to selectively engage or disengage the annular to seat 106 formed on the poppet sleeve 88.

The second end portion 136 of the poppet valve 52 is preferably hollow to define a lower poppet valve cavity 148 shown in FIGS. 2, 3 and 4. Part of the second end portion 136 of the poppet valve 52 is closely guided within the valve body 92. The second end portion 136 of the poppet valve 52 includes an annular second or lower seat 150, an annular peripheral shoulder 152, and a lower annular peripheral groove 154. The shape of the poppet valve lower seat 150 is preferably frusto-conical. The electrical force of the actuator 48 acts on the poppet valve 52 to move the poppet valve 52 in a first direction from a first position 156, as best shown in FIG. 2, to a second position 158, as best shown in FIG. 3. The poppet valve 52 moves in a second direction from the second position to the first position. The first direction and the second direction being opposite one to the other.

Preferably, the poppet sleeve 88 is loosely fitted within the poppet adapter 82 according to selected close positional and diametrical tolerances and the poppet valve 52 is relatively more tightly fitted in the valve body 92 according to selected close positional and diametrical tolerances. The annular shoulder 150 formed on the poppet valve 52 contacts the other end of the poppet spring 90.

The poppet valve 52 is movable between the first position 156 and the second position 158. For example, the total axial displacement of the poppet valve 52 in one direction is about 0.25 millimeters or 0.0098 inches. The first position 156 of the poppet valve 52 is defined as the position at which the poppet valve lower seat 150 is normally seated on a seat 160 of the valve body 92 due to the bias of the poppet spring 90. At the first position 156 of the poppet valve 52, the poppet valve upper seat 146 is normally unseated from the annular seat 106 of the poppet sleeve 88 by a selected clearance.

When the stator assembly 54 is electrically energized, the armature 56 is magnetically attracted towards the stator assembly 54 so that the poppet valve 52 moves axially upward (according to the orientation shown in FIGS. 2 and 3) towards the second position 158. The second position 158 of the poppet valve 52 is defined as the position at which the upper seat 146 of the poppet valve 52 is seated against the annular seat 106 of the poppet sleeve 88. At the second position 158 of the poppet valve 52, the lower seat 150 of the poppet valve 52 is unseated from the seat 160 of the valve body 92.

The lower poppet valve cavity 148 includes a bottom bore 160 having a counter-bounce apparatus 161 positioned therein. The bottom bore 160 is circular and defines a side wall 162 and a bottom 164. Extending through the bottom 164 is a passage 166. The passage 166 connects the lower poppet valve cavity 148 with the pair of passages 142. The remainder of the bottom 164 less the passage 166 defines a bottom or contacting surface 168. A groove 170 is in the side wall 162 of the lower poppet valve cavity 148. The groove 170 has a preestablished width and depth to accommodate a retainer 172, which in this application is a snap ring of conventional construction. The snap ring 172 confines a weight 174 within the lower poppet valve cavity 148. In this application, the weight has a generally cylindrical configuration and defines a preestablished diameter and a preestablished height "H". The height is defined between a first end 176 and a second end 178. As shown in FIG. 4, a preestablished clearance "C" is defined between the second end 178 and the bottom or contacting surface 168. In this application, the clearance "C" is less than the total axial displacement of the poppet valve 52. Thus, the clearance "C" is less than about 0.25 millimeters or 0.0098 inches. 6. The side wall 162 and the movable weight 174 have a clearance therebetween. The clearance between the weight 174 and the side wall 162 being less than the clearance "C". The configuration of the weight 174 enables the weight 174 to move vertically in a free manner within the lower poppet valve cavity 148. For example, as shown in FIG. 2, with the poppet valve 52 in the first position 156 the weight 174 is also in a first position 180. In the first position 180, the first end 176 is in contact with the snap ring 172. As the poppet valve 52 is moved from the first position 156 to the second position 158 abutting actuator 50, the weight 174 is moved into a second position 182 by it momentum. In the second position 182, the second end 178 of the weight 174 is in contact with the bottom or contacting surface 168.

INDUSTRIAL APPLICABILITY

In use the engine 10 is started. As the pistons 18 are moved between the top dead center position and the bottom dead center position, the unit injector 40 injects a quantity of fuel into the respective one of the plurality of cylinders 14 at a preestablished relationship to the top dead center position.

To control the relationship of the injection of fuel by the injector 40 into the cylinder 14, the position of the crankshaft is sensed and correlated to each of the position of the corresponding piston 18 between the top dead center position and the bottom dead center position. As the piston 18 approaches the top dead center position, the solenoid assembly 48 is energized moving the poppet valve 52 into the second position 158 and fuel is injected into the cylinder 14 as a result thereof. As the solenoid assembly 48 is deenergized the poppet valve 52 is moved back into its resting or first position 156.

During the operation of the poppet valve 52 moving from its first position 156 to the second position 158 the armature 56 and the poppet valve 52 act as a unit, is acted on by the solenoid assembly 48 and is transformed from a stationary object into a moving object having momentum. The armature 56 and the poppet valve 52 as a unit move in the first direction and the poppet valve 52 strikes the annular shoulder 108 of the sleeve 88 at the seat 106 of the upper seat 146. The momentum of the unit, armature 56 and poppet valve 52, causes the unit to bounce off of the second surface 60 and move in the second direction toward the first position 156. To counteract this action, the counter-bounce mechanism 161 is used. For example, the weight 174, in its first position 180, also moves with the poppet valve 52. The first end 176 of the weight 174 is in contact with the snap ring 172 and is carried in the first direction upward with the movement of the poppet valve 52. As the armature 56 and the poppet valve 52 come in contact with the second surface 60 of the stator assembly 54, the weight 174 continues to move in the first direction upwardly toward the bottom or contacting surface 168. At or near the moment that the armature 56 and the poppet valve 52 unit is rebounding or bouncing in the second direction from the second surface 60 the second end 178 of the weight 174 comes into contact with the bottom or contacting surface 168 and the resulting rebound or bounce is negated. Thus, any secondary injection of fuel by the injector 40 into the cylinder 14 is prevented.

It has been contemplated that the lineal relationship between the clearance "C" and the gap "G" should have a direct relationship. For example, the clearance "C" should be of a lesser or equal lineal measurement than that of the gap "G". Additionally, the weight of the weight 174 should provide a resulting momentum equal to that of the rebounding or bouncing momentum of the armature 56 and the poppet valve 52 unit.

The apparatus 161 for compensating for the rebound of bounce overcomes the problem of variable injection. For example, as the poppet valve 52 rebounds the weight 174 strikes the bottom or contacting surface 168 preventing the poppet valve 52 from moving toward the first position 156. Thus, the variation in the injection of fuel is prevented or eliminated. Additionally, with the variation in the injection of fuel eliminated, the adverse affects of the bounce or rebound enables better engine governability, high pressure injector fuel flow and idle stability.

What is claimed is:

1. A fuel injector (40) having a poppet valve (52) positioned therein, said poppet valve (52) being operatively movable between a first position (156) and a second position (158); said fuel injector comprising:

a cavity (148) being formed in said poppet valve (52) and defining a contacting surface (168); and a weight (174) being movably positioned within said cavity (148), said weight (174) defining an end (178) being positioned in spaced relationship to said contacting surface (168) with said poppet valve (52) being in said first position (156).

2. The fuel injector (40) of claim 1 wherein said poppet valve (52) being moved to said second position (158) and said poppet valve (52) rebounding toward said first position (156) and said end (178) of said weight (174) coming in contact with said contacting surface (168).

3. The fuel injector (40) of claim 1 wherein said cavity (148) being defined by a circular bore (160) defining a side wall (162) and a bottom (164).

4. The fuel injector (40) of claim 3 wherein said weight (174) has a cylindrical configuration.

5. The fuel injector (40) of claim 1 wherein said contacting surface (168) and said end have a preestablished clearance "C" defined therebetween.

6. The fuel injector (40) of claim 5 wherein said cavity (148) defines a side wall (162) and said movable weight (174) has a clearance between said weight (174) and said side wall (162) and said clearance between said weight (174) and said side wall (162) being less than said clearance "C".

7. A method of reducing the bounce or rebound of a poppet valve (52), said poppet valve (52) when adapted for use having a first position (156) and a second position (158) being spaced one from the other, said poppet valve (52) defining a first direction when being movable from said first position (156) to said second position (158) and defining a second direction when moving from said second position (158) to said first position (156), and a cavity (148) being formed in said poppet valve (52), said cavity (148) defining a bore (160) having a contacting surface (168) therein, and a weight (174) defining an end (178) being movably positioned within said cavity (148); said method comprising the steps of:

positioning said weight (174) within said cavity (148) with said end (178) being adjacent said contacting surface (168);

retaining said weight (174) slidably within said cavity (148);

moving said poppet valve (52) and said weight (174) from said first position (156) to said second position (158) in said first direction;

rebounding said poppet valve (52) from said second position (158) toward said first position (156) in said second direction;

moving said weight (174) in said first direction as said poppet valve (52) is rebounding in said second direction;

contacting said end (178) of said weight (174) with said contacting surface (168) of said poppet valve (52); and stopping said second direction of said poppet valve (52) with said weight (174).

8. The method of reducing the bounce or rebound of a poppet valve (52) of claim 7 wherein said step of positioning said weight (174) within said cavity (148) including said end (178) being spaced from said contacting surface (168).

9. The method of reducing the bounce or rebound of a poppet valve (52) of claim 7 wherein said step of moving said poppet valve (52) and said weight (174) from said first position (156) to said second position (158) in said first direction includes an actuator (48) acting on said poppet valve (52) and said weight (174).

10. The method of reducing the bounce or rebound of a poppet valve (52) of claim 7 wherein said step of moving said weight (174) in said first direction as said poppet valve (52) is rebounding in said second direction includes said weight (174) being moved by a momentum.

11. A poppet valve (52) having a first end portion (132), an intermediate portion (134) and a second end portion (136), an upper seat (146) being positioned on said intermediate portion (134) and a lower seat (150) being positioned on said second end portion (136), said poppet valve (52) comprising:

a cavity (148) being positioned in said second end portion (136) and defining a bore (160) having a side wall (162) and a bottom (164); a groove (170) being formed in said side wall (162);

a retainer (172) positioned in said groove (170); and a weight (174) being movably positioned in said cavity (148).

12. The poppet valve (52) of claim 11 wherein said weight (174) defines an end (178) being positioned adjacent said bottom (164) of said cavity (148).

13. The poppet valve (52) of claim 12 wherein said end (178) and said bottom (164) define a clearance "C" therebetween.

14. The poppet valve (52) of claim 13 wherein said clearance "C" has a preestablished value.

15. The poppet valve (52) of claim 11 wherein said weight (174) defines a first position (180) in which said weight (174) is in contact with said retainer (172).

16. The poppet valve (52) of claim 15 wherein said weight (174) defines a second position (182) wherein said end (178) of said weight (174) is in contact with said bottom (164).

* * * * *